US006186424B1

(12) United States Patent
Uno et al.

(10) Patent No.: US 6,186,424 B1
(45) Date of Patent: Feb. 13, 2001

(54) METHOD AND APPARATUS FOR MANUFACTURING CHIPS FOR A THIXOMOLDING-PROCESS INJECTION MOLDING MACHINE

(75) Inventors: Tadashi Uno, Kanagawa; Kazuo Kitamura, Tokyo, both of (JP)

(73) Assignees: The Japan Steel Works, Ltd.; Nippon Thermochemical Co., Ltd., both of Tokyo (JP)

( * ) Notice: Under 35 U.S.C. 154(b), the term of this patent shall be extended for 0 days.

(21) Appl. No.: 09/179,845

(22) Filed: Oct. 28, 1998

(51) Int. Cl.[7] ..... B02C 19/12

(52) U.S. Cl. ..... 241/19; 241/73; 241/74; 241/65

(58) Field of Search ..... 241/73, 74, 79.1, 241/19, 260, 235, 65

(56) References Cited

U.S. PATENT DOCUMENTS 2,873,663 * 2/1959 Hawk et al. ..... 241/60
2,886,254 * 5/1959 Rohlinger et al. ..... 241/74
2,890,840 * 6/1959 Fletcher et al. ..... 241/73
3,378,210 * 4/1968 Bambach ..... 241/73
3,986,676 * 10/1976 Husmann ..... 241/73
4,934,614 * 6/1990 Lewis ..... 241/73

* cited by examiner

*Primary Examiner*—Mark Rosenbaum
(74) *Attorney, Agent, or Firm*—Sughrue, Mion, Zinn, Macpeak & Seas, PLLC

(57) ABSTRACT

In a method and an apparatus for manufacturing chips for a thixomolding-process injection molding machine, primary crushed pieces obtained by fragmenting and crushing metal alloy wastes are cut and fragmented by a chip manufacturing apparatus having fixed blades, rotating blades, and a screen so as to obtain chips, with the result that the surfaces are polished, and a powder is eliminated by forced exhaust air, thereby making it possible to manufacture the chips while preventing ignition and explosion.

12 Claims, 1 Drawing Sheet

METHOD AND APPARATUS FOR MANUFACTURING CHIPS FOR A THIXOMOLDING-PROCESS INJECTION MOLDING MACHINE

BACKGROUND OF THE INVENTION

1. Field of the Invention

The present invention relates to a method and an apparatus for manufacturing chips for a thixomolding-process injection molding machine, and more particularly to novel improvements for manufacturing a high-purity raw material for recycling by charging into a chip manufacturing device primary crushed pieces obtained by fragmenting and crushing wastes occurring during the molding of a metal alloy and wastes of metal alloy products, and by processing them into chips whose surfaces are polished and in which impurities are removed.

2. Related Art

Conventionally, in a process for molding a magnesium alloy, for example, a die-casting process is generally adopted in which a melt of 620 to 700° C. which is completely melted in a melting furnace is cast into a mold at high pressure.

In contrast, the thixomolding process is a molding process in which a chip-like raw material of a metal alloy is charged into a hopper, and the chips are heated above a solidifying point and below a melting point inside a cylinder by a heater, are thus set in a semimolten state in which the liquid phase and the solid phase coexist, and are poured into a mold.

This injection molding process excels over the die-casting process in the following points:

(1) A melting furnace is not required for the plant.

(2) A large-scale fire-prevention measure is not required for the plant.

(3) A covering flux is not required.

(4) Treatment of dross and sludge is not required.

(5) Melting skills and experience are not required.

(6) The energy cost can be reduced.

(7) Since the raw material with a grain size of 1 to 8 mm is used, there is no possibility of the chips being ignited.

(8) The dendrite (a crystal with a treelike branching pattern) is crushed by a screw and is formed into fine particles with diameters of 35 to 75 mm, and the fluidity of the semimolten metal increases, so that moldings with thin wall thicknesses can be formed.

(9) A completely molten metal whose viscosity is low is liable to form a turbulent flow, but the flow of a semimolten metal whose viscosity is high becomes closer to a laminar flow, so that the amount of a gas entrained is small, and bubbles are therefore difficult to be formed in moldings.

(10) Since the semimolten metal solidifies faster than the completely molten metal, it is possible to reduce the molding cycle time.

(11) The life of the mold can be extended.

(12) The dimensional accuracy improves.

(13) The working environment is excellent.

Partly due to a move toward enactment of a "Household Electrical Appliance Recycling Law," Japanese and foreign major consumer electrical appliance manufacturers, automobile manufacturers, and injection molding manufacturers have en bloc shifted to magnesium alloy moldings that are 100% recyclable and are produced by injection molding which is superior to the die-casting process.

In addition, the magnesium alloys have such characteristics as a heat radiating characteristic and an electromagnetic-wave shielding characteristic in addition to its light weight, thin size, and high rigidity, and is capable of expressing a higher-quality feature than an alloy resin body. Thus, the magnesium alloys have outstanding characteristics.

On the other hand, in the conventional regeneration of magnesium alloy scraps, the scraps are remelted and refined to form ingots, and the ingots were formed into chips again so as to be used.

Although recycling is 100% possible according to the above-described conventional method, a large amount of energy is required, and countermeasures against pollution and waste treatment, including the treatment of exhaust gases, dross, and sludge, are required, resulting in high cost.

SUMMARY OF THE INVENTION

The present invention has been devised to overcome the above-described problems, and its object is to provide a method and an apparatus for manufacturing chips for a thixomolding-process injection molding machine for manufacturing a high-purity raw material for recycling by charging into a chip manufacturing device primary crushed pieces obtained by fragmenting and crushing wastes occurring during the molding of a metal alloy and wastes of metal alloy products, and by processing them into chips whose surfaces are polished and in which impurities are removed.

The method for manufacturing chips for a thixomolding-process injection molding machine in accordance with the present invention comprises: a first step of charging primary crushed pieces, which are obtained by fragmenting and crushing wastes produced at the time of molding a metal alloy as well as wastes of metal alloy products, into a chip manufacturing apparatus having fixed blades, rotating blades, and a screen; a second step of causing the primary crushed pieces to be cut and fragmented by the fixed blades and the rotating blades, and causing the cut and fragmented pieces to pass through and fly outside the screen so as to obtain chips; and a third step of forcedly exhausting a powder mixed with the chips. Further, in this method, the primary crushed pieces have lengths and thicknesses of approximately 5 to 30 mm. Further, in this method, the powder is collected. Further, in this method, the surfaces of the chips are polished during cutting and fragmenting by the fixed blades and the rotating blades. Further, in this method, any one of an aluminum alloy, a zinc alloy, and a magnesium alloy is used as the metal alloy. In addition, the apparatus for manufacturing chips for a thixomolding-process injection molding machine comprises: fixed blades and rotating blades provided inside a chamber; a mesh-like screen provided in a side portion of the chamber; and a chip takeout port provided on an outer side of the screen, wherein primary crushed pieces, which are obtained by fragmenting and crushing wastes produced at the time of molding a metal alloy as well as wastes of metal alloy products, are charged into the chamber and are crushed by the fixed blades and the rotating blades so as to obtain chips, and the chips which have passed through the screen are collected. Further, cooling vanes are provided above the rotating blades, and a coarse surface plate is provided on a bottom portion of the chamber.

DETAILED DESCRIPTION OF THE PREFERRED EMBODIMENTS

Figure 1:
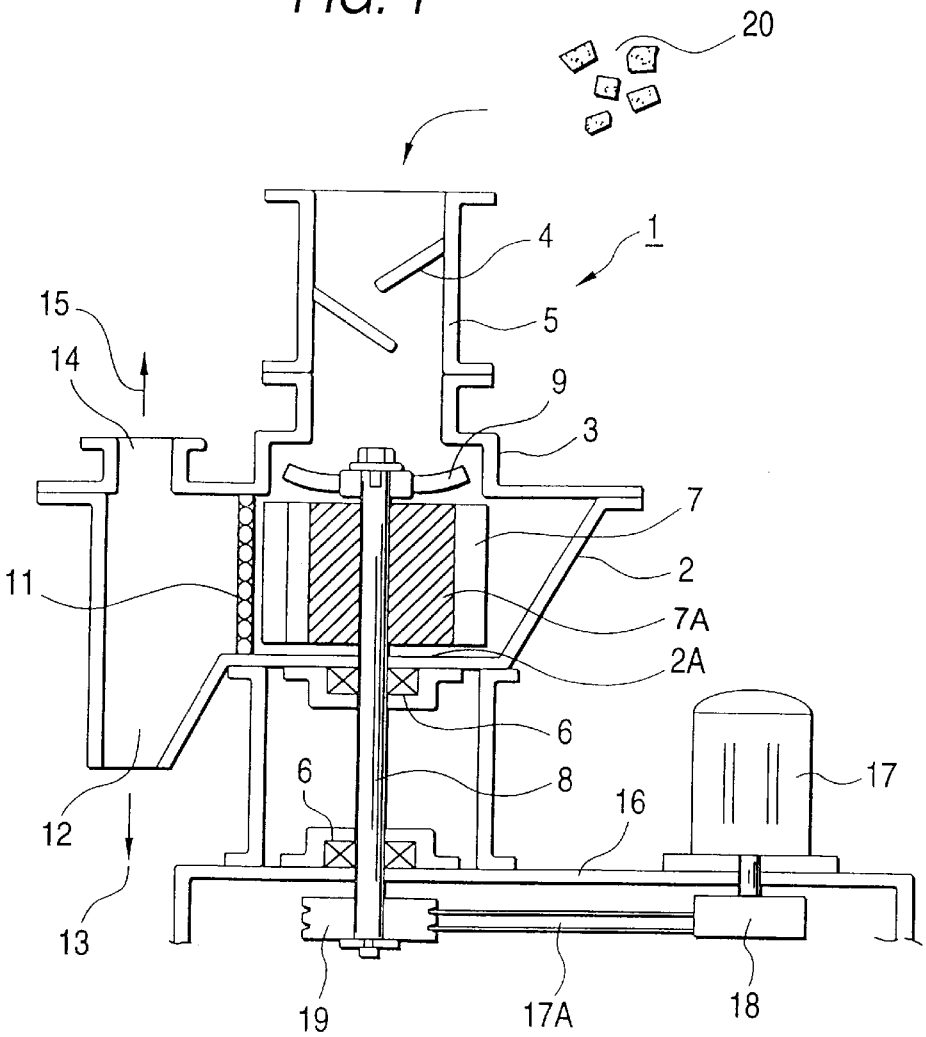
FIG. 1 is a front cross-sectional view illustrating a chip manufacturing apparatus in accordance with the present invention.

Hereafter, referring to the drawings, a description will be given of preferred embodiments of a method and an apparatus for manufacturing chips for a thixomolding-process injection molding machine in accordance with the present invention.

Figure 2:
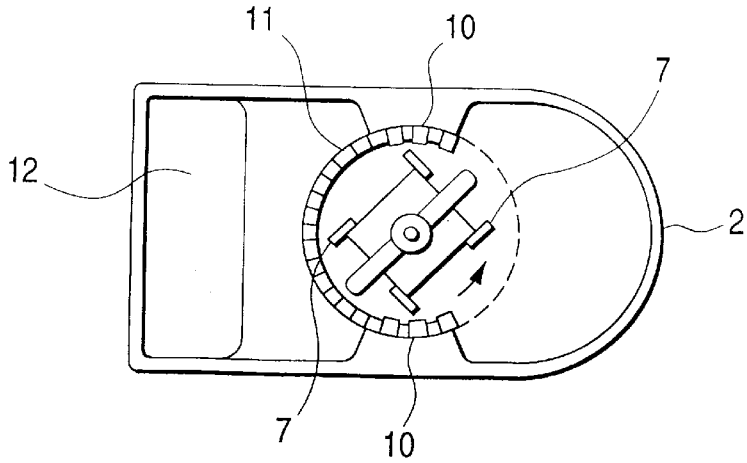
FIG. 2 is a plan cross-sectional view of FIG. 1.

FIGS. 1 and 2 are a front cross-sectional view and a plan cross-sectional view, respectively, illustrating a chip manufacturing apparatus.

In FIG. 1, a chip manufacturing apparatus is denoted by reference numeral 1, and a charging hopper 5 having scattering-preventing plates 4 formed in the shapes of downwardly slanting plates is provided on an upper cover 3 of a chamber 2 of the chip manufacturing apparatus 1.

A rotating shaft 8 having rotating blades 7 and rotors 7A is rotatably provided in the aforementioned chamber 2 via bearings 6, and cooling vanes 9 are provided on top of the rotating shaft 8. A plurality of vertically arranged fixed blades 10 are provided in mutually opposing pairs on side portions of the chamber 2. The gap between each fixed blade 10 and each rotating blade 7 is set to approximately 0.5 to 2 mm, and a mesh-like screen 11 is disposed in an arcuate shape in a state in which the screen 11 connects the fixed blades 10. In addition, a file-like coarse surface plate 2A is provided on a bottom portion of the chamber 2.

A chip takeout port 12 for taking out chips 13 is formed at an outside position of the screen 11 of the chamber 2. An exhaust port 14 is formed on top of the chip takeout port 12, and a powder 15 mixed with the chips 13 taken out from the chip takeout port 12 is exhausted to the outside by means of cooling exhaust air, is collected by an unillustrated powder collecting machine, and is reutilized as such as a desulfurizing agent for iron manufacture. It should be noted that although this cooling exhaust air is sent from the aforementioned cooling vanes 9, it is possible to use an unillustrated other cooling air-blowing means. Further, the rotating shaft is constructed so as to be rotatively driven by a motor 17 provided on a base 16, a pair of pulleys 18 and 19, and a belt 17A.

Next, a description will be given of the operation. First, if primary crushed pieces 20, which have lengths and thicknesses of approximately 5 to 30 mm and are obtained by fragmenting and crushing wastes such as spools produced at the time of molding a metal alloy as well as unwanted metal alloy products from facilities and the like, are charged into the charging hopper 5, the primary crushed pieces 20 are consecutively cut and fragmented into small pieces by the fixing blades 10 and the rotating blades 7 which rotate by the rotation of the motor 17. Then, the chips 13 which are 1 to 8 mm in shape together with the powder 15 pass through the screen 11 and fly out to the chip takeout port 12. At this time, the powder is discharged upward by the cooling exhaust air, and only the chips 13 fall downward and are collected.

At the time of the above-described chip manufacturing, the chips 13 which were cut and fragmented by the rotating blades 7 and the fixed blades 10 remain inside the chamber 2 in the process of being consecutively cut and fragmented into small pieces by the blades 7 and 10, and their surfaces are ground sufficiently between the screen 11 and the rotating blades 7 and between the rotating blades 7 and the coarse surface plate 2A, and friction between the particles additionally acts on the surfaces. Thus, impurities which were formed on the surfaces are removed so as to form the powder 15.

In addition, unless the powder 15 is forcedly eliminated from inside the chamber 2 during the aforementioned crushing, ignition and explosion will take place. Hence, the interior of the chamber 2 is cooled by the rotation of the cooling vanes 9, and the powder 15 is exhausted from the exhaust port 14. Further, as a countermeasure against ignition and explosion referred to above, the chips 13 are manufactured by cutting and fragmenting the primary crushed pieces 20 by means of the fixed blades 10 and the rotating blades 7, instead of crushing them by impact.

Next, when the above-described chips 13 were subjected to chemical analysis, the results were as shown in Table 1 below, and it was revealed that the chips 13 satisfied the JIS standards without the mixture of impurities.

TABLE 1

| | Results of Analysis of Composition of Raw Material Chips (AZ-911) | | | | | | |
|---|---|---|---|---|---|---|---|
| | Al | Zn | Mn | Si | Cu | Ni | Fe |
| Virgin material (Product of this invention) | 8.89 | 0.70 | 0.25 | 0.01 | ≦0.005 | ≦0.001 | ≦0.004 |
| Recycling material (direct chips) | 8.76 | 0.72 | 0.20 | 0.02 | ≦0.005 | ≦0.001 | ≦0.004 |
| JIS Standard | 8.5–9.5 | 0.45–0.9 | ≧0.17 | ≦0.08 | ≦0.015 | ≦0.001 | ≦0.004 |

In addition, Table 2 shows the results in which round-rod tensile test pieces of the ASTM Standard size were molded by a known thixomolding-process injection molding machine by using the chips 13, and their mechanical properties at ordinary temperature were examined. Values which bore comparison were obtained when a comparison was made between the case in which virgin chips were used 100% and the case in which the chips 13 in accordance with the present invention were used 100%.

It should be noted that although recycling chips are ordinarily used by being mixed with the virgin material, it became clear that no problem is presented even if the recycling chips are used 100% since the aforementioned values are obtained.

TABLE 2

| | Mechanical Properties of Recycling Chips | | | |
|---|---|---|---|---|
| | Virgin Material (N = 3) | | Recycling Material (N = 15) (Product of This Invention) | |
| | Tensile Strength (Mpa) | Elongation (%) | Tensile strength (Mpa) | Elongation (%) |
| Minimum | 243.7 | 3.0 | 256.2 | 5.3 |
| Maximum | 288.8 | 9.6 | 287.3 | 9.2 |
| Average | 266.4 | 7.0 | 277.0 | 7.8 |
| Standard deviation | 12.1 | 1.7 | 9.5 | 1.2 |
| Die cast (JIS) | 230.0 | 3.0 | — | — |

It should be noted that any one of an aluminum alloy, a zinc alloy, and a magnesium alloy whose melting points are 700° C. or less is used as the metal material used for the above-described molding. In addition, die casting and injection molding can be used as the molding means.

As described above, since the method and the apparatus for manufacturing chips for a thixomolding-process injection molding machine in accordance with the present invention are arranged as described above, it is possible to obtain the following advantages.

That is, since the primary crushed pieces, which are obtained by fragmenting and crushing wastes produced at the time of molding a metal alloy as well as wastes of metal alloy products, are formed into chips by using the fixed blades, the rotating blades, and the screen while polishing them, almost all the impurities on the chip surfaces are removed, so that it is possible to ensure quality close to that of a good-quality virgin material. In addition, since the power which is produced at the time of formation of the chips is eliminated by forced exhaust air, it is possible to completely prevent the ignition and explosion of the powder.

Further, if the chips in accordance with the present invention are used by being mixed with virgin chips, the cost of thixomolding injection moldings can made substantially lower than the conventional case, thereby contributing to the widespread use of the moldings.

In addition, by the use of these chips, it is possible to make large contributions to the global environmental problem which has been an issue, labor saving, and energy conservation.

What is claimed is:

1. A method for manufacturing chips for a thixomolding-process injection molding machine, comprising the steps of:

charging primary crushed pieces, which are obtained by fragmenting and crushing wastes produced at the time of molding a metal alloy as well as wastes of metal alloy products, into a chip manufacturing apparatus having fixed blades, rotating blades, and a screen;

cutting and fragmenting the primary crushed pieces by said fixed blades and said rotating blades, and passing the cut and fragmented pieces through and flying outside said screen so as to obtain chips; and forcedly exhausting a powder mixed with the chips.

2. The method for manufacturing chips for a thixomolding-process injection molding machine according to claim 1, wherein the primary crushed pieces have a length and thickness of between approximately 5 to 30 mm.

3. The method for manufacturing chips for a thixomolding-process injection molding machine according to claim 1, wherein the powder is collected.

4. The method for manufacturing chips for a thixomolding-process injection molding machine according to claim 1, wherein surfaces of the chips are polished during the cutting and fragmenting by said fixed blades and said rotating blades.

5. The method for manufacturing chips for a thixomolding-process injection molding machine according to claim 1, wherein any one of an aluminum alloy, a zinc alloy, and a magnesium alloy is used as the metal alloy.

6. An apparatus for manufacturing chips for thixomolding-process injection molding machine, comprising:

fixed blades and rotating blades provided inside a chamber for cutting and fragmenting into chips primary crushed pieces of material fed into said chamber;

a mesh-like screen provided in a side portion of said chamber;

a chip takeout port provided on an outer side of said screen;

a powder exhaust port for separately exhausting powder initially mixed with the primary crushed pieces; and a collector for collecting the chips made from the primary crushed pieces fed into said chamber and which have passed through the screen;

cooling vanes provided above said rotating blades; and a coarse surface plate provided on a bottom portion of said chamber.

7. An apparatus for manufacturing chips for thixomolding-process injection molding machine, comprising:

fixed blades and rotating blades provided inside a chamber for cutting and fragmenting into chips primary crushed pieces of material fed into said chamber;

a mesh-like screen provided in a side portion of said chamber;

a chip takeout port provided on an outer side of said screen;

cooling vanes provided above said rotating blades, and a coarse surface plate provided on a bottom of said chamber; and a collector for collecting the chips made from the primary crushed pieces fed into said chamber and which have passed through said screen.

8. A method for manufacturing chips for a thixomolding-process injection molding machine comprising the steps of:

charging metal alloy primary crushed pieces into a chip manufacturing apparatus having fixed blades, rotating blades, and a screen;

cutting and fragmenting the primary crushed pieces by said fixed blades and said rotating blades, and passing the cut and fragmented pieces, together with a powder obtained from the cutting and fragmenting of the primary cut pieces, through and flying outside the screen so as to obtain chips mixed with the powder; and forcedly exhausting the powder from the chips.

9. The method for manufacturing chips for a thixomolding-process injection molding machine according to claim 8, wherein the primary crushed pieces have a length and thickness of between approximately 5 to 30 mm.

10. The method for manufacturing chips for a thixomolding-process injection molding machine according to claim 8, wherein the powder is collected.

11. The method for manufacturing chips for a thixomolding-process injection molding machine according to claim 8, wherein surfaces of the chips are polished during the cutting and fragmenting by the fixed blades and the rotating blades.

12. The method for manufacturing chips for a thixomolding-process injection molding machine according to claim 8, wherein one of an aluminum alloy, zinc alloy, and magnesium alloy is used as the metal alloy for the primary crushed pieces.

* * * * *

UNITED STATES PATENT AND TRADEMARK OFFICE

CERTIFICATE OF CORRECTION

PATENT NO. : 6,186,424 B1
DATED : February 13, 2001
INVENTOR(S) : Tadashi Uno, Kazuo Kitamura It is certified that error appears in the above-identified patent and that said Letters Patent is hereby corrected as shown below:

Title page,
Insert the following: [30] Foreign Application Priority Data

July 15, 1998 Japan .....10/200662

Signed and Sealed this

Eleventh Day of September, 2001

*Attest:*

Nicholas P. Godici

*Attesting Officer*

NICHOLAS P. GODICI
*Acting Director of the United States Patent and Trademark Office*